US009295316B2

(12) United States Patent
Mathiez

(10) Patent No.: US 9,295,316 B2
(45) Date of Patent: Mar. 29, 2016

(54) ASSEMBLY OF CONTAINER/APPLICATOR FOR A MASCARA COMPOSITION

(75) Inventor: Jean-Louis Mathiez, Limours (FR)

(73) Assignee: CINQPATS, Limours (FR)

( * ) Notice: Subject to any disclaimer, the term of this patent is extended or adjusted under 35 U.S.C. 154(b) by 0 days.

(21) Appl. No.: 14/110,634

(22) PCT Filed: Apr. 5, 2012

(86) PCT No.: PCT/FR2012/050754
§ 371 (c)(1),
(2), (4) Date: Oct. 8, 2013

(87) PCT Pub. No.: WO2012/143646
PCT Pub. Date: Oct. 26, 2012

(65) Prior Publication Data

US 2014/0030002 A1 Jan. 30, 2014

(30) Foreign Application Priority Data

Apr. 8, 2011 (FR) ..... 11 53105

(51) Int. Cl.
*A45D 40/26* (2006.01)
*A45D 34/04* (2006.01)

(52) U.S. Cl.
CPC ..... *A45D 40/265* (2013.01); *A45D 34/048* (2013.01)

(58) Field of Classification Search
CPC ..... A45D 34/048
USPC ..... 401/4
See application file for complete search history.

(56) References Cited

U.S. PATENT DOCUMENTS 3,738,760 A 6/1973 Madeira
4,290,706 A * 9/1981 Wandl ..... 401/4
4,960,339 A * 10/1990 Iizuka et al. ..... 401/129
5,192,153 A 3/1993 Gueret (Continued)

FOREIGN PATENT DOCUMENTS

EP 0 350 535 A2 1/1990
EP 0 745 369 A 12/1996

(Continued)

OTHER PUBLICATIONS

International Search Report, dated Jul. 25, 2012, from corresponding PCT application.

*Primary Examiner* — David Walczak
*Assistant Examiner* — Joshua Wiljanen
(74) *Attorney, Agent, or Firm* — Young & Thompson

(57) ABSTRACT

An assembly of a container/applicator for mascara, includes: along a longitudinal axis, a flask, including a side wall and a distal bottom wall, whose lower surface defines a receiving cavity for a mascara composition, and a proximal neck having an opening, the neck having a draining element and first members for maintaining the assembly in a combined and closed configuration; an applicator, including a stem having a distal brush-supporting section, an intermediate section, and a proximal handling section, and a brush supported by the distal section; a cap provided with second members for maintaining the assembly in the combined and closed configuration; and mixing elements arranged in the receiving cavity, which are capable of being moved axially between the distal bottom wall and the proximal neck. The mixing elements have a generally tubular wall, whose upper and lower surfaces peripherally define a central through-passage for the stem of an applicator.

20 Claims, 6 Drawing Sheets

(56) References Cited

U.S. PATENT DOCUMENTS

| | | | | |
|---|---|---|---|---|
| 5,226,744 | A | 7/1993 | Kemmerer | |
| 5,328,287 | A * | 7/1994 | Gilb | 403/231 |
| 6,024,507 | A * | 2/2000 | Joulia | 401/4 |
| 7,931,140 | B2 * | 4/2011 | Heidenreiter | 206/219 |
| 2009/0110465 | A1 * | 4/2009 | Biegel et al. | 401/118 |
| 2010/0239515 | A1 | 9/2010 | Arditty | |

FOREIGN PATENT DOCUMENTS

| | | | |
|---|---|---|---|
| EP | 2 269 571 | A2 | 1/2011 |
| FR | 2 663 823 | A1 | 1/1992 |
| FR | 2 844 709 | A1 | 3/2004 |
| FR | 2 943 250 | A | 9/2010 |
| JP | 9 117711 | A | 5/1997 |
| WO | 2009/133265 | A2 | 11/2009 |

* cited by examiner 24b
23
23b
6
22a 23
24b
23b
6
22a 23
24b
23b
6
22a 23
24b
23b
6
22a 24b
23
23b
6
22a 23
24b
23b
6
22a 23
23b
24b
22a
6

23b
23
24b
6
22a 23
23b
24b
22a
6

ASSEMBLY OF CONTAINER/APPLICATOR FOR A MASCARA COMPOSITION

This invention relates to mascara containers and, more particularly, it has as its object a container-applicator assembly of mascara composition (container and contents), a container-applicator assembly for a mascara composition (container only, without the contents), a container-mixer assembly (portion of the container comprising the bottle and the mixing part), the process for using such a container-applicator assembly of mascara and a process for the production of such a container-mixer assembly.

A container-applicator of mascara is already known that comprises, extending along a longitudinal axis, (i) a bottle comprising a side wall and a bottom whose inside surface delimits a cavity for receiving a mass of mascara, and a neck with an opening, provided with squeezing means and first elements for holding the container-applicator in a combined and closed configuration, (ii) an applicator comprising a rod having a brush carrier section, an intermediate section and a handling section, and a brush, and (iii) a cap provided with second elements for holding the container-applicator in the combined and closed configuration. Such a container-applicator is therefore also known that is devoid of the mass of mascara, also called a container-applicator assembly for mascara.

In an embodiment, the applicator and the cap are rigidly combined with one another, the handling section of the rod being crimped or welded or rigidly combined in another manner in a holding housing made in the cap, so that the user does not directly handle the applicator, strictly speaking, or its rod, but the cap that, beyond its closing function, performs a handling function.

With such assemblies, the bottle and the applicator can be found either in a so-called "separated" configuration where the rod and the brush are entirely located outside of the receiving cavity and the mass of mascara, for example when the user is applying the mascara, or in a so-called "combined end-of-travel" configuration where the brush is located in the receiving cavity against or in the vicinity of the bottom, and in the mass of mascara, for example when the user is not using the container-applicator of mascara at all that is then stored or put away, or even in an intermediate configuration and particularly a so-called "combined mid-travel" configuration where the brush is then located in any intermediate position between the bottom and the neck and its opening, for example when the user extracts the brush from the receiving cavity through the opening, and therefore from the mass of mascara, or, conversely, when the user inserts the brush into the receiving cavity through the opening, and therefore into the mass of mascara.

The bottle and the cap can be found either in a so-called "separated and open" configuration where the cap is structurally separated from the bottle and where the opening of the bottle is open, or in a so-called "combined and closed" configuration where the first and second holding elements work with one another, so that the cap is structurally combined with the bottle and so that the opening of the bottle is closed, by the fit between the rod and the bottle around its opening and by the closing contact between the bottle and the cap.

In the embodiment where, as indicated, the applicator and the cap are rigidly combined with one another, when the bottle and the applicator are in the separated configuration, the bottle and the cap are for their part in the separated and open configuration, and when the bottle and the applicator are in the combined end-of-travel configuration, the bottle and the cap are in the combined and closed configuration.

A mascara composition (sometimes designated hereafter mascara, for short) can be the object of various embodiments (see, for example, the documents FR-A-2844709, FR-A-2943250 and EP-A-2269571) that have in common a nonhomogeneous constitution, for example comprising several phases (oily, aqueous, solid, . . . ), or an unstable constitution that can become separated into several phases as a result of variations of temperature or an extended storage period.

In general, a mascara composition is called thixotropic because its viscosity naturally increases over time; from fluid at the time of its production, it becomes thick at the end of several days or weeks.

Moreover, in the case of these compositions in the form of emulsions or gels, the properties of viscosity can vary as a result of the application of mechanical shear stresses on the fluid. This variation of viscosity, or rheology, can be useful to give more effectiveness to the composition: a rheofluidizing composition becomes less viscous under the action of mechanical stress and will be easier to apply, whereas conversely, a rheothickening composition becomes more viscous and can, in certain cases, make it possible to deposit quickly a greater quantity of mascara.

For these reasons, it is wise to mix the mascara composition correctly before use by the user.

In contrast, it is shown that most often, the mascara composition tends to adhere to the side wall of the bottle, which takes away from the efficient use of the container-applicator.

It has therefore been proposed that a container-applicator for (or of) mascara also comprises a mixing means located in the receiving cavity and in the mass of mascara, which can be axially displaced in the receiving cavity, between the bottom and the neck, and within the mass of mascara, while being able to mix this mass of mascara.

Document FR-A-2663823 describes a container-applicator comprising such a mixing means arranged to pivot and cooperating with a helical groove made on the inside surface of the side wall of the bottle. This structure has the drawback of being complex and of needing to apply a significant force to overcome the resistance to the moving of the mixing means.

Document EP-A-0350535 describes a container-applicator comprising such a mixing means arranged to slide and driven by the applicator, which cannot be satisfactory.

Document US-5226744 describes a container-applicator in which the mixture of the mascara composition is ensured by the cooperation of the shape of the inside surface of the side wall of the bottle and the free end of the bristles of the brush. Such an embodiment is not satisfactory because the amount of mascara composition is greatly reduced, and the shape necessary for the side wall of the bottle negatively affects its aesthetic quality and its ease of handling.

Document EP 0 350 535 describes a container-applicator assembly of mascara that comprises a sliding part that scrapes the inside surface of the side wall of the bottle, which is necessarily cylindrical. In an embodiment, this sliding part is in contact with a slight pressure on the inside surface of the side wall of the bottle. This sliding part is composite, being formed by two parts, namely a body in which a heavy weight is arranged. The body comprises a flared lower skirt that ensures said contact with slight pressure. The heavy part is moved up and down with a continuous contact on the inside surface of the side wall of the bottle when the container-applicator assembly is shaken. It is thus possible to avoid the solidification of the mascara and to avoid its being deposited on the inside surface of the side wall of the bottle, the deposited mascara being scraped away. This document does not explain how it is possible to make a sliding part that at the same time scrapes the inside surface of the side wall of the bottle to be in contact with it with a slight pressure and is moved up and down with a continuous contact on the inside surface of the side wall of the bottle when the container-applicator assembly is shaken. In fact, not only is it not known how to make a part that slides up and down in a mass of mascara by mere shaking of the container-applicator assembly of mascara, but even more so, it is not known since provision has been made, in a mandatory way as in this particular case, for a contact friction with pressure from the part on the inside surface of the side wall of the bottle.

There are fields other than that of the container-applicators of mascara in which a problem of mixing also arises. Reference can be made to the documents U.S. Pat. No. 4,290,706 and EP-A-745369 that relate more particularly and respectively to paints and medications. However, the packaging used in these other fields do not exhibit the characteristics expected of a container-applicator for (or of) mascara, apart from the fact that the compositions concerned do not have the constitution and the nature of the mascara composition. It is the same when the composition is liquid.

The document U.S. Pat. No. 3,738,760 thus describes a container suited for touch-ups on an automobile body. This container has two storage chambers. It comprises an applicator brush and a hollow agitator is placed in the first chamber on the brush. A hollow agitator is disposed within the first chamber about the brush.

Furthermore, the document WO 2009/133265 describes a process for welding between a neck and a tank body of a container of plastic material able to receive a fluid product, the neck and the body forming a pair of elements to be welded that are placed in alignment along a main axis and exhibiting two contact surfaces opposite one another, characterized in that a joining wall of at least one of the neck and/or body elements to be welded exhibits a partially linear tapering in thickness in relation to the rest of the element, at least one of the joining walls of the elements to be joined then having a contact surface that is inclined in relation to the main axis, forming between them an angular gap of at least approximately 3° to 5° between them, wherein the radial dimensions of the contact walls are such that the joining wall of an element is introduced in contact in the wall of the other element, wherein a force is applied to one of the elements to put the contact surfaces under stress, and wherein the thinned wall(s) having a radially deformable structure during the advance of the wall, an energy input fuses the plastic material of the contact surfaces then joined to one another in local areas hollowed out in these surfaces to form a volume of fused material, this fusing step being followed by a cooling step.

The problem underlying the invention is therefore, in the case of a container-applicator for (or of) mascara, to achieve a mixing means, suited to the characteristics of mascara, and that at the same time is effective in terms of operation, in particular does not become blocked, is easy to use by the user, in particular does not require too considerable a force, ensures not only the mixing but the recovery of the mascara that can stick to the side wall of the bottle, is of simple design and production, is economical, is not very bulky so as not to adversely affect the capacity of the container-applicator, and finally does not affect the aesthetics of the container-applicator.

If the invention is especially advantageous in the case of a mascara composition, it can also be considered in the case of another composition exhibiting similar requirements, intended to be applied on keratin fibers or on the skin.

For this purpose, according to a first aspect, the invention has as its object a container-applicator assembly for a mascara composition comprising, along a longitudinal axis :

- a bottle, comprising a side wall and a distal bottom whose inside surface delimits a receiving cavity able to receive a mascara composition, and a proximal neck with an opening, provided with squeezing means and with first elements for holding the assembly in a combined and closed configuration,
- an applicator comprising a rod having a brush carrier distal section, an intermediate section and a proximal handling section, and a brush carried by the distal section,
- a cap provided with second elements for holding the assembly in the combined and closed configuration,
- and a mixing means placed in the receiving cavity, capable of being able to be moved axially between the distal bottom and the proximal neck while being able to mix the mascara composition that is in the receiving cavity. Said mixing means being rigid and of a general tubular shape with an outside surface and an inside surface peripherally bounding a traversing central passage that can be passed through by the rod of the applicator, and two end cant edges.

This mixing means is a mixing part having a wall in a general tubular shape, whose weight is between five and fifty grams and whose density is greater than five, made of a heavy metal alloy such as zamak, steel, a copper alloy or the like, whose area of the end cant edge or of its projection on a transverse plane being less than 0.5 times, and more particularly 0.4 times, the area of a transverse section of the receiving cavity, and whose outside surface is away from the inside surface of the bottle, by a space whose radial dimension is slight, relatively, in comparison with the transverse dimensions of the outside surface of the mixing part and of the inside surface of the side wall of the bottle.

According to an embodiment, the outside surface and/or the inside surface of the mixing part has a general cylindrical or slightly tapered shape, with a generatrix that is a straight or slightly curved section, and a directrix that is closed or open and whose shape, or whose envelope shape, is circular, pseudo-circular, ellipsoidal, polygonal or pseudo-polygonal.

According to the embodiments, the outside surface and the inside surface of the mixing part have shapes that are at least approximately homothetic to one another or have shapes that are not homothetic to one another.

According to the embodiments, the outside surface of the mixing part and the inside surface of the side wall of the bottle have shapes that are at least approximately homothetic to one another or have shapes that are not homothetic to one another.

According to an embodiment, the tubular wall of the mixing part is at least approximately solid.

According to an embodiment, the two end cant edges of the mixing part are at least approximately identical or similar.

According to an embodiment, the traversing central passage of the tubular wall of the mixing part has a sufficient transverse opening to be able to be passed through by the brush of the applicator, in particular a transverse opening such that it is able to be passed through by the brush of the applicator that, in its large transverse dimension, is separated from the inside surface of the mixing part.

According to an embodiment, the distal and/or proximal end cant edge of the mixing part is located at least approximately in a transverse plane and exhibits a face and extends either transversely or in a more or less strongly inclined way, depending on the resistance to penetration in the desired mascara composition.

According to an embodiment, the axial length of the mixing part is at least in the vicinity of the axial length of the brush of the applicator and/or is at most equal to 0.5 times the axial length of the receiving cavity.

According to an embodiment, the weight of the mixing part is greater than 15 grams, more particularly is in the vicinity of or greater than on the order of twenty grams.

According to an embodiment, the density of the mixing part is greater than 6.5, more particularly greater than 7.5, and more particularly still greater than on the order of eight.

According to an embodiment, the mixing part is made by cutting a pre-existing tube, by rolling a sheet, or by molding.

According to an embodiment, the mixing part comprises a corrosion-resistant coating.

According to an embodiment, the radial dimension of the space between the outside surface of the mixing part and the inside surface of the side wall of the bottle is less than on the order of 0.08 times the large transverse dimension of the outside surface of the mixing part and/or is less than on the order of 0.10 times the large transverse dimension of the inside surface of the side wall of the bottle.

According to an embodiment, the outside surface of the mixing part is separated from the inside surface of the side wall of the bottle so that the axial movement of the mixing part is not hampered by a rubbing on the inside surface of the side wall of the bottle, while the smallness of the space between the outside surface of the mixing part and the inside surface of the side wall of the bottle is such that the mixing part tends to prevent the accumulation of mascara composition on the inside surface of the side wall of the bottle.

According to an embodiment, the bottle is made of two parts, rigid in their assembly, rigidly joined with one another, so as to be able to place the mixing part in the receiving cavity before the rigid joining of the two parts, in particular one of the parts comprising the bottom and the other of the parts comprising the neck, for example one exhibiting a thinning and the other being inclined, the two surfaces being placed in contact under stress by an axial force, the two contact surfaces being fused for their rigid assembling.

According to an embodiment, the bottle has a general elongated shape along the longitudinal axis, such as a cylindrical or slightly tapered shape with a generatrix that is a straight or slightly curved section, and a directrix that is closed and whose shape, or whose envelope shape, is circular, pseudo-circular, ellipsoidal, polygonal or pseudo-polygonal.

According to an embodiment, the receiving cavity has an axial length at least equal to on the order of three times the large transverse dimension of the inside surface of the bottle.

According to an embodiment, the applicator and the cap are combined rigidly with one another.

According to an embodiment, the container-applicator assembly comprises in addition, combined with the bottle and with the mixing part, holding means that in the active state ensure the holding in position of the mixing part in the receiving cavity so as to prevent or limit its axial movement between the distal bottom and the proximal neck and in the inactive state do not hamper the movement of the mixing part in the receiving cavity, said holding means being initially in the active state and being returned to the inactive state when the receiving cavity is going to be filled or has just been filled with the mascara composition. For example, the holding means in the active state ensure the holding in position of the mixing part against or in the vicinity of the distal bottom.

According to an embodiment, the container-applicator assembly further comprises, combined with the bottle and with the mixing part, damping means of end-of-travel axial displacement in one direction and/or in the other of the mixing part in the receiving cavity.

According to an embodiment, the bottle and the applicator are either in a separated configuration where the brush is located outside of the receiving cavity or in a combined configuration where the brush is located in the receiving cavity or in a distal position where it is against or in the vicinity of the distal bottom or in a proximal position where it is against or in the vicinity of the neck or of the squeezing means or in an intermediate position.

According to an embodiment, the bottle and the cap are either in a separated and open configuration where the cap is structurally separated from the bottle and where the opening of the bottle is open or in a combined and closed configuration where the first holding elements and the second holding elements work with one another, where the cap is combined structurally with the bottle and where the opening of the bottle is closed.

In particular, when the bottle and the applicator are in the separated configuration, the bottle and the cap are in the separated and open configuration, and when the bottle and the applicator are in the combined configuration, the bottle and the cap are in the combined and closed configuration.

In a configuration of the container-applicator assembly for a mascara composition described above, the receiving cavity is devoid of mascara composition.

According to a second aspect, the invention has as its object a container-mixer assembly specially intended to be part of a container-applicator assembly for a mascara composition in the configuration that has just been described, comprising, along a longitudinal axis:

- a bottle, comprising a side wall and a distal bottom whose inside surface delimits a receiving cavity able to receive a mascara composition, and a proximal neck with an opening, provided with squeezing means and with first elements for holding the assembly in a combined and closed configuration,
- and a mixing means placed in the receiving cavity, capable of being able to be moved axially between the distal bottom and the proximal neck while being able to mix the mascara composition that is in the receiving cavity, said mixing means being rigid and of a general tubular shape with an outside surface and an inside surface peripherally bounding a traversing central passage that can be passed through by the rod of the applicator, and two end cant edges.

This mixing means is a mixing part having a wall of a general tubular shape, whose weight is between five and fifty grams and whose density is greater than five, made of a heavy metal alloy such as zamak, steel, a copper alloy or the like, whose area of the end cant edge or of its projection on a transverse plane being less than 0.5 times, and more particularly 0.4 times, the area of a transverse section of the receiving cavity, and whose outside surface is away from the inside surface of the bottle, by a space whose radial dimension is slight, relatively, in comparison with the transverse dimensions of the outside surface of the mixing part and of the inside surface of the side wall of the bottle.

According to an embodiment of the container-mixer assembly that has just been described, the bottle is made of two parts, rigid in their assembly, rigidly joined with one another, so as to be able to place the mixing part in the receiving cavity before the rigid joining of the two parts, one of the parts comprising the bottom and at least a substantial part of the side wall adjoining the bottom and the other of the parts comprising the neck and as the case may be a part adjoining the side wall.

According to an embodiment, the two constituent parts of the bottle are rigidly joined to one another in two contact surfaces, one exhibiting a thinning and the other being inclined, the two surfaces being placed in contact under stress by an axial force, the two contact surfaces being fused for their rigid assembling.

According to a third aspect, the invention has as its object a container-applicator assembly of mascara that comprises a container-applicator assembly for a mascara composition as described above and a certain amount of mascara composition forming a mass of mascara filling the receiving cavity, said mascara composition being nonhomogeneous or unstable, such as an emulsion or a gel, and viscous in nature and/or thixotropic, such that by a shaking—the required number of times—of the container-applicator assembly of mascara in the combined and closed configuration, in one direction and in the other, the mixing part is moved by inertia in the axial direction in the receiving cavity in one direction and in the other while passing through the mass of mascara, which ensures the desired degree of mixing of the mascara composition.

According to a fourth aspect, the invention has as its object a process for using a container-applicator assembly of mascara as has just been described in which :

- a container-applicator assembly of mascara is available in the combined and closed configuration,
- then, the container-applicator assembly of mascara is shaken as many times as necessary in one direction and in the other with at least one component in the axial direction, so that the mixing part is moved by inertia in an axial direction in the receiving cavity in one direction and in the other while passing through the mass of mascara, and thus the desired degree of mixing of the mass of mascara is ensured,
- then, the first holding elements and the second holding elements are separated, and the container-applicator assembly of mascara is then brought into the separated and open configuration of the bottle and of the cap and into the separated configuration of the bottle and of the applicator,
- the applicator is manipulated as desired to transfer the mascara composition from the brush.

In an embodiment, a process for the production of a container-mixer assembly as described above is such that :

- the two constituent parts of a bottle are available, the one comprising the bottom and at least a substantial part of the side wall adjoining the bottom and the other comprising the neck and as the case may be a part adjoining the side wall, the two parts being separated from one another,
- a rigid mixing part is available, which has a wall of a general tubular shape with an outside surface and an inside surface peripherally bounding a traversing central passage that can be passed through by an applicator rod, and two end cant edges, the area of an end cant edge or of its projection on a transverse plane being less than 0.5 times the area of a transverse section of the receiving cavity of a bottle formed by the assembling of the two constituent parts, whose weight is between five and forty grams and whose density is greater than 5,
- then, the mixing part is available in one of the two constituent parts of the bottle,
- then, the two constituent parts of the bottle are joined rigidly to one another so as to form the bottle, and thus a container-mixer assembly is obtained whose mixing part is placed in the receiving cavity of the bottle with its outside surface away from the inside surface of the side wall of the bottle by a relatively slight radial free space in comparison with the transverse dimensions of the outside surface of the mixing part and of the inside surface of the side wall of the bottle.

According to an embodiment, two constituent parts of the bottle are available that have two contact surfaces, one exhibiting a thinning and the other being inclined, and the two surfaces are put into contact under stress by an axial force and are fused for their rigid assembling.

According to an embodiment:

- two constituent parts of the bottle and a mixing part are available such that joined to them are holding means that in the active state ensure the holding in position of the mixing part in the receiving cavity so as to prevent or limit its axial movement between the distal bottom and the proximal neck and in the inactive state do not hamper the movement of the mixing part in the receiving cavity, said holding means being initially active and being rendered inactive when the receiving cavity is going to be filled or has just been filled with the mascara composition,
- the mixing part is available in one of the two constituent parts of the bottle, with the holding means that are active or rendered active,
- then, the two constituent parts of the bottle are joined to one another rigidly with the active holding means until the filling with the mascara composition.

Several embodiments of the invention are now described with reference to the following drawings:

FIG. 1 is one in section by an axial plane of an implementation variant of a container-applicator assembly of mascara composition, comprising a container-applicator assembly for a mascara composition, forming a container, filled with a certain appropriate amount of mascara composition, its contents, the container-applicator assembly for a mascara composition like the container-applicator assembly of mascara composition, being found in the configuration where the bottle and the applicator are in the so-called "combined end-of-travel" configuration and where the bottle and the cap are in the so-called "combined and closed" configuration, the applicator and the cap here being rigidly joined with one another.

Figure 1:
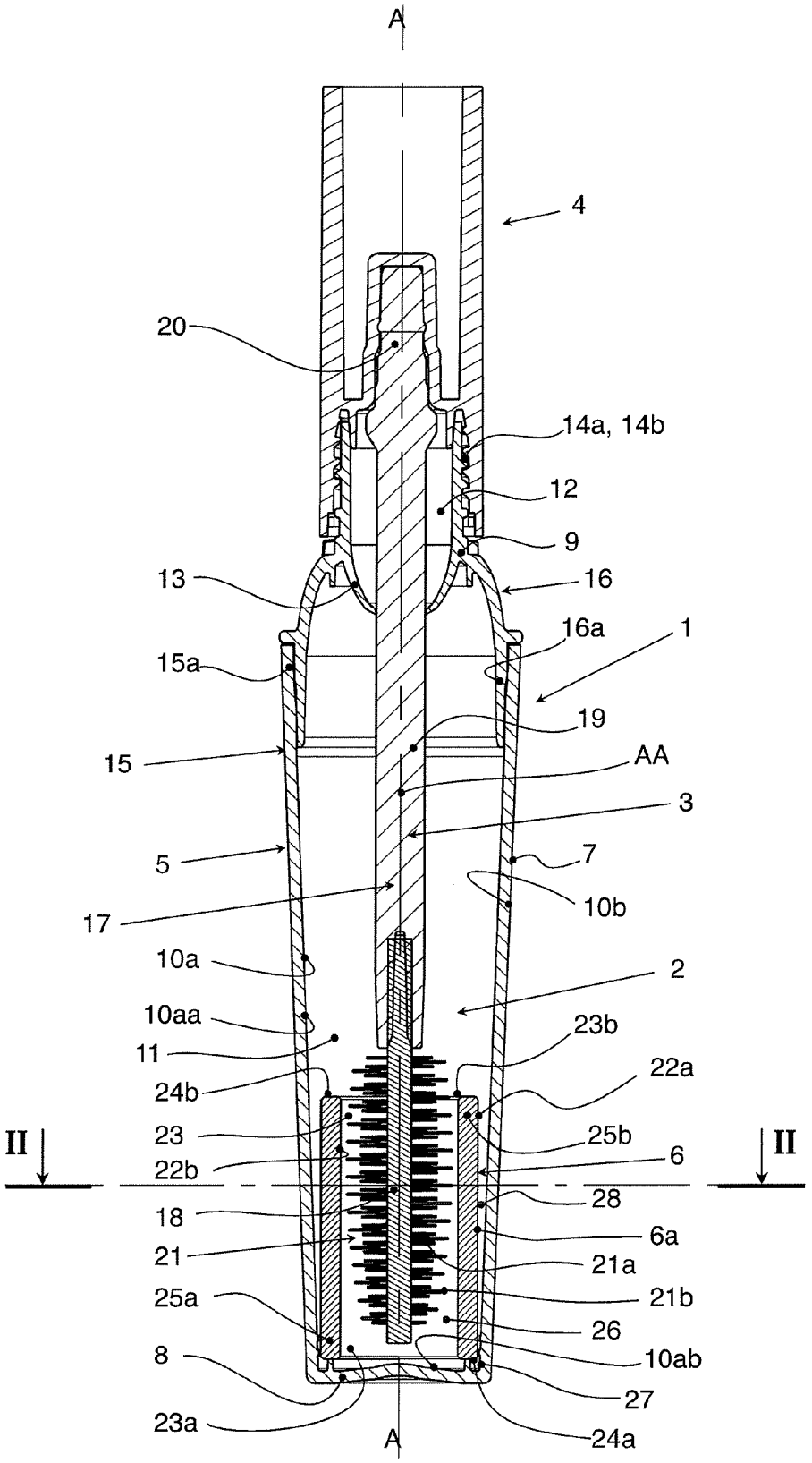

In a particular embodiment given purely by way of example, a container-applicator assembly for a mascara composition 1 (sometimes designated hereafter container-applicator for mascara 1 for short) comprises a container-mixer assembly 2 (sometimes designated hereafter container-mixer 2 for short), an applicator 3 and a cap 4. The container-mixer assembly 2 comprises a bottle 5 and a mixing part 6.

Figure 2:
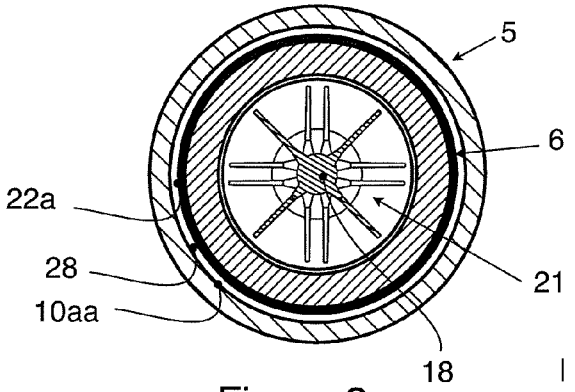
FIG. 2 is one in section by a transverse plane of the container-applicator assembly of mascara composition and of the container-applicator assembly for a mascara composition of FIG. 1, along the section line II-II located toward the distal bottom, facing the mixing part in which the brush is found.
Figure 3:
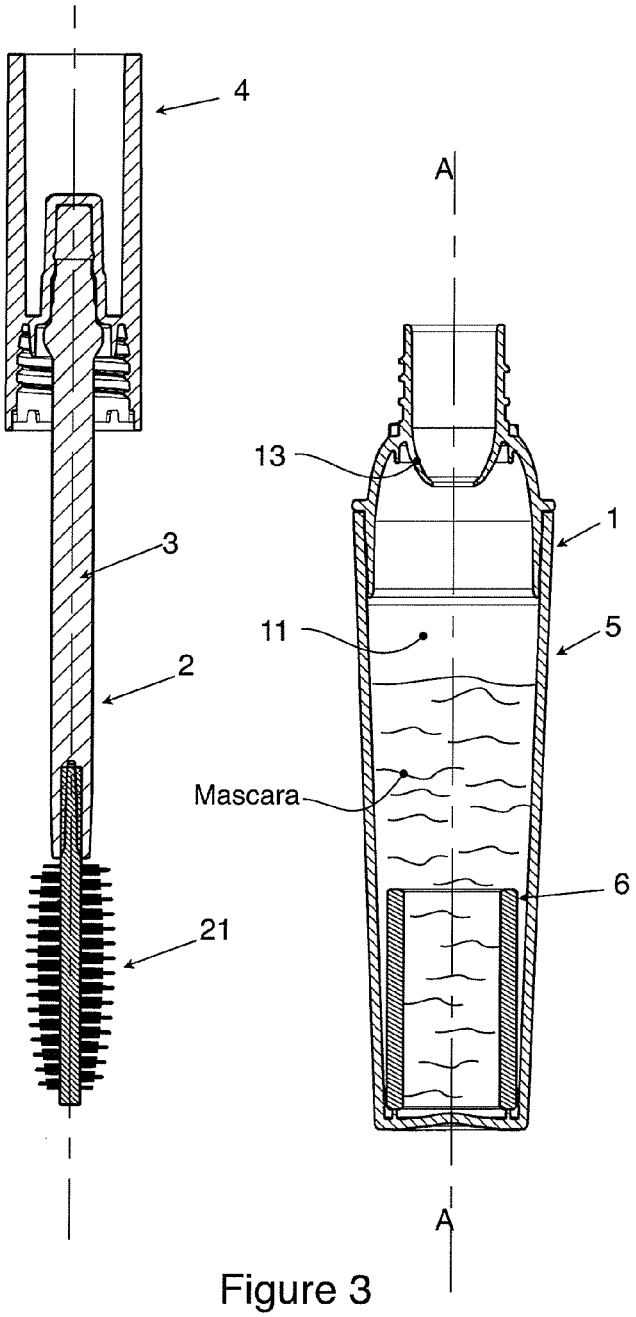
FIG. 3 is one in section by an axial plane of the container-applicator assembly of mascara composition of FIG. 1, which is found in the configuration where the bottle and the applicator are in the so-called "separated and open" configuration, while the bottle is filled with mascara.

By "container-applicator assembly for a mascara composition 1" or "container-applicator for mascara 1" for short is meant the assembly 1 in question when it is devoid of mascara (FIGS. 1 and 2). When the assembly 1 in question is filled with a mass of mascara corresponding to the appropriate amount (FIG. 3), it is designated by the expression "container-applicator assembly of mascara composition" (sometimes designated hereafter container-applicator of mascara for short).

The invention has as its object both the container-applicator 1 as well as the container-mixer 2 and the container-applicator of mascara. It also has as its object the process for using such a container-applicator of mascara. By that is meant how the user uses such a container-applicator in connection with the characteristics of the invention. Finally, it has as its object the implementation process of such a container-mixer 2.

The container-mixer 2 and the container-applicator for mascara 1 are especially intended to receive and contain a mass of mascara, the mascara being intended to be subsequently used by the user.

The chemical, physical, and utilitarian properties of a mascara composition (or mascara for short) are known or are within the scope of a person skilled in the art and therefore have not been described further, these properties being implicit. Such a mascara composition can be the object of different embodiments that have in common a nonhomogeneous or unstable makeup that can be separated into several phases. In general, such a mascara composition is thixotropic, its viscosity naturally increasing over time, from fluid at the time of its production to thick at the end of several days or weeks. Moreover, the properties of viscosity can vary as a result of the application of mechanical shear stresses on the fluid, which makes it possible to impart more effectiveness to the composition. Thus, in all cases, it is important to mix correctly the mascara composition before use by the user. In contrast, it is possible that the mascara composition tends to adhere to the inside surface of the side wall of the bottle of the container-applicator for mascara 1 and it is important to remedy that. The container-mixer 2 and the container-applicator for (or of) mascara are specially designed and arranged for such a mascara composition, both for the mixing before use by the user and for remedying the adhesion to the inside surface of the side wall of the bottle of the container-applicator.

The object of the invention is also the case where the contents of the container-applicator are not a mascara composition but a composition having one and/or the other of the aforementioned characteristics: need of mixing, need of eliminating the risk of adhesion to the inside surface of the side wall of the bottle of the container-applicator. That is how the expression "mascara composition" and the term "mascara" must be understood here.

The general characteristics of a container-applicator of mascara are known or are within the scope of a person skilled in the art and therefore have not been further described, these characteristics being implicit.

A container-applicator for mascara 1, such as a container-mixer 2, exhibits a longitudinal axis AA along which are placed, in a more or less distal or proximal way, its constituent parts : bottle 5, applicator 3, mixing part 6 and cap 4.

By "distal" and "proximal" are meant two opposite directions along axis AA, namely, for "distal" that which is opposite from the side, or the farthest from the side, or turned in the direction opposite to the side, where the mascara composition must exit from the container-applicator assembly 1 for its use by the user, and, for "proximal" that which is toward the side, or closest to the side, or turned in the direction of the side where the mascara composition must exit from the container-applicator assembly 1 for its use by the user. By "radial" and by "transverse" is meant that which is placed at right angles or approximately at right angles to the axis AA.

By the terms "bottle," "applicator," "mixing part" and "cap," by themselves nonlimiting, are meant assemblies, sub-assemblies, units or devices designed so as to be able to ensure the function, respectively : of containing a mass of mascara, of sampling the mascara from the mass of mascara, extracting it from the container-applicator, applying it for its final use, of mixing the mass of mascara, and finally of closing the container-applicator in a removable way.

In a particular embodiment given purely by way of example, a single container-applicator for (or of) mascara is proposed comprising a single container-mixer 2, a single applicator 3, and a single cap 4. The invention, however, also has as its object the case of a double container-applicator applicator for (or of) mascara, comprising two container-mixers 2, two applicators 3, two caps 4 or a double cap, these two sub-assemblies being placed side by side or coaxially opposite, with a common bottom or two adjacent or close bottoms.

The bottle 5 comprises a side wall 7 provided on the distal side with a bottom 8 and on the proximal side with a neck 9. The bottle 5 (and therefore side wall 7, bottom 8, and neck 9) comprises an inside surface 10*a*—including one inside surface 10*aa* for the side wall 7 and one inside surface 10*ab* for the bottom 8—and an outside surface 10*b*. The inside surface 10*a* delimits a receiving cavity 11, able to receive the appropriate amount of mascara composition. In a typical embodiment, given purely by way of example, the receiving cavity 11 has a total volume equal to or on the order of 20 milliliters, which is suitable for a filling of 8 to 15 milliliters of mascara. The amount (volume or weight) of mascara is determined as a function of its physical-chemical characteristics, of the size of the brush, and of the volume occupied by the mixing part. A "traditional" mascara is filled between 60 and 80% of the total volume of the receiving cavity. Here, the optimal filling level must be determined by tests to obtain an effective mixing and a correct and uniform metering on the brush. Preferably, the inside surface 10*a*—and quite especially the inside surface 10*aa*—is arranged or treated, more generally is designed, so as to be smooth and/or so that the mascara composition tends to adhere to it as little as possible in an undesirable way. The outside surface 10*b* forms a—main (in size)—part of the outside face of the container-applicator for (or of) mascara 1. This outside face comprises or receives a facing or designs that are decorative, informative, or commercial (such as the name of the manufacturer, the trademark of the mascara, and its characteristics).

The neck 9 comprises a transverse opening 12, and it is provided, in the preferred embodiment shown, with squeezing means 13 and with first holding elements 14*a* of the container-applicator for mascara 1, such as the container-applicator of mascara, in a combined and closed configuration, able to work with second holding elements 14*b* that are complementary with the first, for which cap 4 is provided.

The general characteristics of squeezing means 13 for a container-applicator for (or of) mascara 1, such as wall portions forming a contraction, are known or are within the scope of a person skilled in the art and therefore do not have to be further described, these characteristics being implicit. It is the same for the first and second holding elements 14*a*, 14*b* of the container-applicator for (or of) mascara 1, such as screw threads, projections, pins, recesses . . . .

The terms "side wall," "bottom," "neck," "opening," "inside surface," "outside surface," "receiving cavity," "squeezing means," and "holding elements" are not by themselves limiting. By "inside surface" is meant that which is turned toward, or is the closest to, the axis AA. By "outside surface" is meant that which is turned from the opposite side of the axis AA, or is the farthest from the axis AA.

Figures 5A, 5B, 5C:
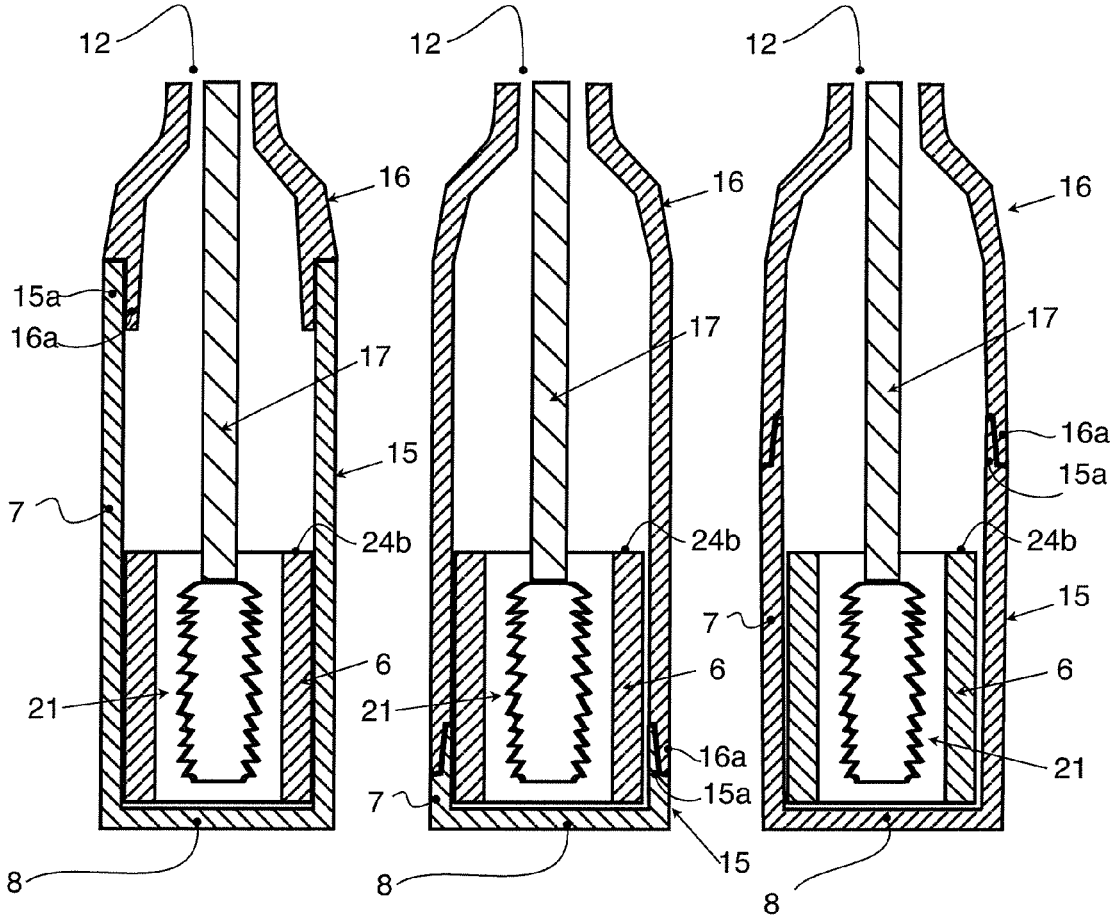
FIGS. 5A, 5B and 5C are three partial views in axial section that illustrate three variant embodiments of the bottle in two parts.

The bottle 5 exhibits a certain mechanical strength and rigidity of assembly. It is typically made of plastic material. The bottle 5 is made of two parts 15 and 16 that are rigid in their assembly, joined to one another rigidly, by their annular edge portions 15*a*, 16*a*, so as to be able to place the mixing part 6 in the receiving cavity 11, before the rigid joining of the two parts 15 and 16. Actually, in the embodiment envisaged, the transverse bulk of the mixing part 6 does not make it possible for it to pass through the opening 12 of the smaller neck 9. In the embodiment shown in FIG. 5A, given purely by way of example, the part 15 is a bottom part 15 comprising the bottom 8 and at least a substantial part of, or all of, the side wall 7 adjoining the bottom 8. The part 16, in this case, is a neck part 16 comprising the neck 9 and, as the case may be, a—limited—adjoining part of the side wall 7.

In the embodiment of FIG. 5B, the part 15 is a bottom part 15 comprising the bottom 8 and a part adjoining the side wall 7 that is very limited axially, whereas the part 16 is a neck part 16 comprising the neck 9 and all or substantially all of the adjoining side wall 7.

In the embodiment of FIG. 5C, the two parts 15 and 16 each comprise a part of the side wall 7.

The two parts 15 and 16 are joined rigidly to one another in two contact surfaces of their annular edge portions 15*a*, 16*a*, respectively. To ensure a good, rigid hold of the two parts 15 and 16, the process as described in the document WO 2009/133265 is preferably provided to be used.

For this purpose, one of the parts 15, 16, or its annular edge portion 15*a*, 16*a*, exhibits a thinning and the other of the parts 16, 15, or its annular edge portion 16*a*, 15*a*, is inclined. According to the process, the two surfaces of the annular edge portions 15*a*, 16*a* are placed in contact under stress by an axial force, and they are fused for their rigid assembling.

In a typical way, but purely by way of example, the bottle 5 has a general elongated shape along the longitudinal axis AA, such that, for example, the receiving cavity 11 has an axial length at least equal to on the order of three times, more particularly four times, still more particularly five times, the large transverse (diametric) dimension of the inside surface 10*aa* of the side wall 7 of the bottle 5. In a typical embodiment, given purely by way of example, the bottle 5 has an overall axial length on the order of ten centimeters, an inside diameter (at the level of the inside surface 10*aa*) going from on the order of 1.5 centimeters to on the order of two centimeters, a larger outside diameter (at the level of outside surface 10*b*) on the order of two centimeters to 2.5 centimeters, a thickness of side wall 7 on the order of two millimeters, while the opening 12 has a diameter on the order of five millimeters.

In a typical way, but purely by way of example, the bottle 5 has a general tapered shape (wider toward the proximal part than toward the distal part as in the case of the Figure) with a generatrix that is a straight section (case of the Figure) or slightly curved, and a directrix that is closed and whose shape, or whose envelope shape, is circular (case of the Figure), or pseudo-circular, ellipsoidal, polygonal or pseudo-polygonal. It should be noted that such shapes cannot be envisaged with arrangements of the state of the art that comprise a scraping part. When applicable, the bottle 5 can have a general cylindrical shape.

The applicator 3 has a rod 17 with a certain mechanical strength, able to be placed and to be extended axially, having a distal brush carrier section 18, an intermediate section 19, and a proximal handling section 20.

The applicator 3 also has a brush 21 carried by the distal section 18 of the rod 17 able to be placed and extended axially.

By "rod," since the term is not in itself limiting, is meant any elongated carrier element or means having on the distal side a brush carrier part, directly or indirectly, on the proximal side a handling part, directly or indirectly, and an intermediate part between them, so that the brush carrier part is separated from the handling part, along the axis of the rod. Such a rod 17 can be the object of different variant embodiments, the particular embodiment shown in the figures being only purely by way of example.

By "brush," since the term is not in itself limiting, is meant any element or means able to be loaded with a certain amount of mascara composition that is found in the receiving cavity 11 and able to transfer it outside of the latter, with an appropriate metering and distribution ensured by the squeezing means 13. Such a brush 21 can be the object of different variant embodiments and can appear in the form of a comb, a brush or an end piece of foam-type plastic material, the particular embodiment shown in the figures being only purely by way of example.

In a typical way, but purely by way of example, the rod 17 has a general cylindrical shape whose diameter is on the order of four millimeters and whose overall axial length is on the order of ten centimeters, the brush carrier section 18, tapered toward its distal free end having an axial length on the order of three centimeters or slightly less, the handling section 20 having an axial length on the order of three to six centimeters, and the intermediate section 19 having an axial length on the order of five to ten centimeters.

In a typical way, but purely by way of example, the brush 21 has an axial length on the order of two to three centimeters, and it has bristles 21*a* that exhibit a shape, a rigidity and more generally characteristics suited to the desired results concerning the application, installed around the section 18 of the rod 17 more or less radially, while being placed along radial planes or helical lines or of any other suitable manner, the free outside ends 21*b* of the bristles 21*a* fitting in an envelope of a general cylindrical or slightly tapered shape (smaller toward the distal end than toward the proximal end), whose diameter can be between on the order of five to ten millimeters. The brush can also have undergone an operation for cutting the bristles according to one of the known processes and can have bristles of different lengths. The outer profile of the brush in the radial plane can be polygonal (triangular, square, . . . ) with facets, or star-shaped.

The bottle 5 and the applicator 3 can be found in a so-called "separated" configuration where the rod 17 and the brush 21 are located entirely outside of the receiving cavity 11 and, as the case may be, outside of the mass of mascara, for example when the user applies the mascara, a small amount of mascara, appropriate for the application envisaged, then being found on the brush 21.

As shown in FIGS. 1, 5A, 5B, 5C, 6C, and 7, since this is only by way of example, the bottle 5 and the applicator 3 can be found in a so-called "combined end-of-travel" configuration where the distal section 18 and the intermediate section 19—or a substantial part of the intermediate section 19—of the rod 17, and the brush 21, are located in the receiving cavity 11, as the case may be in the mass of mascara. In this configuration, the brush 21 is located against or in the vicinity of the bottom 8, as the case may be in the mass of mascara that is going to make it possible for the brush to be loaded with a small amount of mascara, when that is desired for its use by the user. Such is the case, for example, when the user does not use at all the container-applicator of mascara that is then stored or put away, or when the user uses the container-applicator of mascara, that is to say, as explained previously, uses it not for the application but in connection with the characteristics of the invention.

The bottle 5 and the applicator 3 can also be found in an intermediate configuration between the two preceding end configurations, particularly a "combined mid-travel" configuration (FIG. 6B), the brush 21 then being located in any intermediate position between the bottom 8 and the neck 9 and its opening 12, while the intermediate section 19 of the rod 17 is located partly in the receiving cavity 11, as the case may be in the mass of mascara, and partly outside it. Such is the case, for example, when the user extracts the brush 21 from the receiving cavity 11, through the opening 12, and with the use of the squeezing means 13, as the case may be extracts the brush 21 from the mass of mascara, or, conversely, when the user inserts the brush 21 into the receiving cavity 11, through the opening 12, as the case may be inserts the brush 21 into the mass of mascara.

The general characteristics of an applicator 3, of an applicator rod 17 and of an applicator brush 21 are known or are within the scope of a person skilled in the art and therefore have not been further described, these characteristics being implicit.

In the embodiment shown purely by way of example in the figures, the applicator 3 and the cap 4 are rigidly combined with one another, the proximal handling section 20 of the rod 17 being crimped or welded or rigidly joined in another manner in a retaining housing made in the cap 4. With such an embodiment, the user does not directly handle the applicator 3, strictly speaking, or its rod 17, but the cap 4 that then performs two functions: a closing function and a handling function.

The bottle 5 and the cap 4 can be in a so-called "separated and open" configuration (FIGS. 3, 6A) where the cap 4 is structurally separated from the bottle 5 and where the opening 12 of the bottle 5 is open. They can be in a so-called "combined and closed" configuration (FIGS. 1, 6C, 7) where the first and second holding elements 14*a* and 14*b* work with each other, so that the cap 4 is structurally combined with the bottle 5 and so that the opening 12 of the bottle is closed, by the fit between the rod 17 and the bottle 5 around the opening 12 and by the closing contact between the bottle 5 and the cap 4. Such design arrangements are known or are within the scope of a person skilled in the art and therefore have not been further described, these characteristics being implicit.

In the embodiment where the applicator 3 and the cap 4 are rigidly combined with one another, when the bottle 5 and the applicator 3 are in the separated configuration, the bottle 5 and the cap 4 are for their part in the separated and open configuration. And, when the bottle 5 and the applicator 3 are in the combined end-of-travel configuration, the bottle 5 and the cap 4 are in the combined and closed configuration.

The mixing part 6 constitutes a mixing means placed in the receiving cavity 11, capable of being able to be moved axially between the bottom 8 and the neck 9 while thus being able to mix and to blend the mass of mascara that is found in the receiving cavity 11, regardless of the degree of filling of the receiving cavity 11.

The mixing part 6 is rigid. It comprises a wall 6*a* of a general tubular shape, solid or approximately solid, with an outside surface 22*a* and an inside surface 22*b*, the latter peripherally bounding a traversing central passage 23, and two end transverse cant edges, of a general annular shape, such as that of the wall 6*a*, namely a distal cant edge 24*a* and a proximal cant edge 24*b*, which, in the embodiment shown, purely by way of example, are identical, in any case at least approximately identical or similar. The two cant edges 24*a* and 24*b* delimit, on the inside, two openings, respectively a distal opening 23*a* and a proximal opening 23*b*, at the distal end 25*a* and at the proximal end 25*b* of the mixing part 6 and of the wall 6*a*.

By "rigid" is meant that the mixing part 6, and therefore the wall 6*a*, is firm overall on the outside to be able to absorb impacts, as opposed to a fluid consistency.

By "general tubular shape" is meant a hollow elongated shape with an opening at each end, on each side.

In the embodiment shown, the outside surface 22*a* and the inside surface 22*b* of the mixing part 6 are homothetic to each other and of a general cylindrical shape with a generatrix that is a straight section and a directrix that is closed and whose shape is circular. The two end transverse cant edges, respectively distal 24*a* and proximal 24*b*, then have a circular ring contour, and the openings that are respectively distal 23*a* and proximal 23*b* have a circular contour. In addition, the shape of a straight transverse section of the mixing part 6 is constant over the entire axial length of the part 6. The general shape of the mixing part 6 is thus more or less similar to that of an annular cylinder.

The transverse shapes having a circular contour of the wall 6*a*, of the passage 23 and of its openings 23*a* and 23*b*, and of the cant edges 24*a* and 24*b*, concerning the mixing part 6, and of the rod 17 and of the brush 21, concerning the applicator 3, and of the inside surface 10*aa*, concerning the wall 7 of the bottle 5, exhibit the advantage that the cooperation of the bottle 5, the applicator 3 and the mixing part 6 can be achieved regardless of the relative angular position of one in relation to the other.

In the embodiments shown in FIGS. 1, 3 and 4A to 4H, the distal end cant edge 24*a* and/or proximal end cant edge 24*b* of the mixing part 6 is located in a transverse plane in relation to the axis AA and exhibits a face that extends transversely. These embodiments are not, however, exclusive from others in which the distal end cant edge 24*a* or the proximal end cant edge 24*b*, alone, is located at least approximately in a transverse plane, and/or the cant edge and the face of the cant edge extends in a more or less strongly inclined way, and/or has a more or less uneven shape, as illustrated by FIG. 41, and this, depending on the desired resistance to penetration into the mass of mascara.

Figures 4A, 4B, 4C, 4D, 4E, 4F, 4G, 4H, 4I:
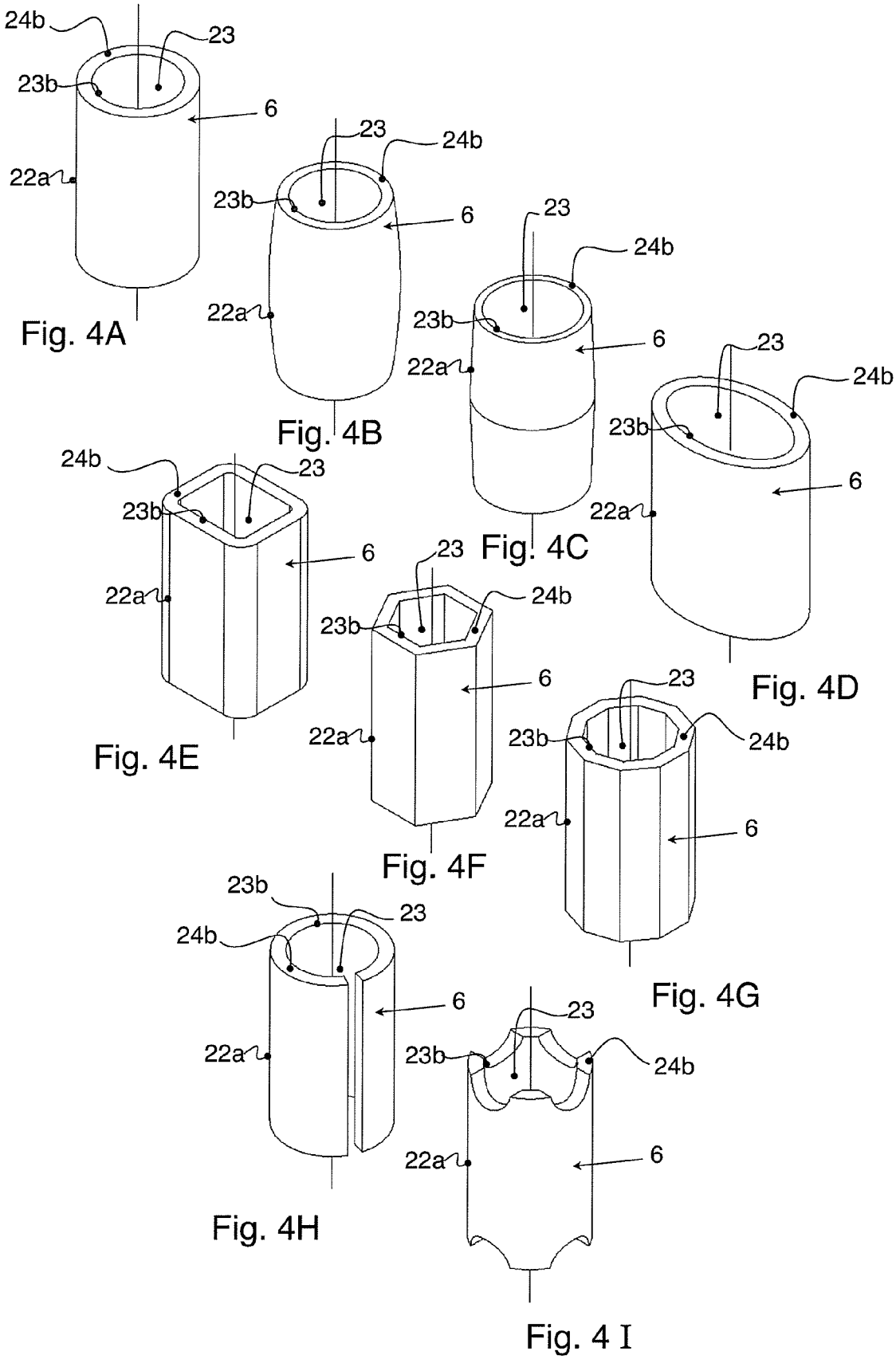
FIGS. 4A to 4I are nine views in perspective of nine possible, nonlimiting embodiments of the mixing part.

The embodiment described above of the mixing part 6 is not, however, exclusive of others in which the wall 6*a* is perforated and/or in which the outside surface 22*a* and/or the inside surface 22*b* is of a general cylindrical or slightly tapered shape, with a generatrix that is a straight or slightly curved section or any other combination (FIGS. 4B and 4C), and a directrix that is closed (FIGS. 4A to 4G and 4I) or open (FIG. 4H) and whose shape, or whose envelope shape, is circular (FIGS. 4A to 4C and 4I), pseudo-circular, ellipsoidal (FIG. 4D), polygonal (FIGS. 4E to 4G) or pseudo-polygonal. According to the embodiments, the outside surface 22*a* and the inside surface 22*b* have shapes that are at least approximately homothetic to one another or, conversely, the outside surface 22*a* and the inside surface 22*b* have shapes that are not homothetic to one another. According to the embodiments, the two transverse end cant edges, respectively distal 24*a* and proximal 24*b*, have an annular contour with a shape other than that of a circular ring, and the openings that are respectively distal 23*a* and proximal 23*b* have a contour other than circular. In addition, it can be envisaged that the shape of a straight transverse section of the mixing part 6 is not constant over the entire axial length of the part 6. According to the embodiments, the shape of a straight transverse section of the mixing part 6 is not constant over its entire axial length. For example, the shape can be similar to a trunk of a cone, in one direction or in the other, to a big-bellied barrel shape (FIG. 4B), to a narrowed diabolo shape, or any other more or less complex shape, including a combination of other more elementary shapes (FIG. 4C). This is combined with a side wall that, according to the embodiments, is solid or conversely is perforated, particularly slotted axially (FIG. 4H), these embodiments not being limiting.

In the embodiment shown, the outside surface 22*a* of the mixing part 6 and the inside surface 10*aa* of the tubular wall of the bottle 5 have shapes that are homethetic to each other. This embodiment is not exclusive of others in which the outside surface 22*a* and the inside surface 10*aa* have shapes that are only at least approximately homothetic to each other or, even conversely, have shapes that are not homothetic to each other.

In the embodiment shown, the outside surface 22*a* and the inside surface 22*b* of the mixing part 6 are smooth, with a surface state that has a non-stick capacity or a characteristic of slight adhesion. However, in other embodiments, the outside surface 22*a* and the inside surface 22*b* have, in contrast, a non-smooth surface state.

The traversing central passage 23 of the tubular wall 6*a* of the mixing part 6, that is to say the inside surface 22*b* of the mixing part 6, and in particular the openings 23*a* and 23*b*, have a free transverse opening that is sufficient to be able to be passed through by the rod 17 and by the brush 21 of the applicator 3. In the embodiment shown, the large transverse dimension of the brush 21, namely the free end 2 lb of its bristles 21*a*, is separated from the inside surface 22*b* of the mixing part 6 by a space 26 whose general shape is more or less similar to that of an annular cylinder, the bottle 5, the applicator 3, and the mixing part 6 being placed coaxially or approximately coaxially. Thus, the loading of the bristles 21*a* of the brush 21 with the mascara neither prevents nor even hinders mascara that is found in the passage 23, particularly in the space 26, and the bristles 21*a* of the brush 21 remain free, despite the possible presence around the brush 21 of the mixing part 6.

In the embodiment shown, the axial length of the mixing part 6 is at least in the vicinity of the axial length of the brush 21 of the applicator 3 and/or at most equal to 0.5 times the axial length of the receiving cavity 11. For example, the mixing part 6 has an axial length of on the order of two to three centimeters, its outside surface 22*a*, its inside surface 22*b*, and its openings 23*a* and 23*b* have a diameter on the order of 1.5 centimeters, and its wall 6*a* has a thickness on the order of two millimeters.

In the embodiment shown, when the mixing part 6 is at the distal axial end of travel and rests by its distal cant edge 24*a* on the inside surface 10*ab* of the bottom 8, because the container-applicator for (or of) mascara is placed resting on its bottom 8 below and with the upward-downward (particularly vertical) axis AA—such as is the case, for example, when the container-applicator is stored or presented for sale or awaiting use—the part of its outside surface 22*a* located toward the distal end 25*a* is adjacent to the distal annular end 27 of the inside surface 10*aa* of the side wall 7 of the bottle 5. By "adjacent" is meant that there is a little radial play between the bottle 5 and the mixing part 6, as the case may be a slight contact. Such a design arrangement makes it possible, when the container-applicator for (or of) mascara is placed resting on its bottom 8 with the upward-downward axis AA, to prevent an incongruous radial movement of the mixing part 6 in the bottle 5 and its receiving cavity 11.

Setting aside, as the case may be, the relative position of the bottle 5 and of the mixing part 6 that has just been described when the container-applicator for (or of) mascara is placed resting on its bottom 8 with the upward-downward axis AA, the outside surface 22*a* of the mixing part 6 is separated from the inside surface 10*aa* of the side wall 7 of the bottle 5 by a space 28 whose general shape is more or less similar to that of an annular cylinder. This space 28 has a small radial dimension, relatively, in comparison with the transverse dimensions of the outside surface 22*a* of the mixing part and of the inside surface 10*aa* of the side wall 7 of the bottle 5.

Thus, on the one hand, the axial movement of the mixing part 6 is not hampered by the rubbing of the latter on the inside surface 10*aa* of the side wall 7 of the bottle 5. On the other hand, the smallness in radial direction of the space 28 between the outside surface 22*a* of the mixing part 6 and the inside surface 10*aa* of the side wall 7 of the bottle 5 is such that the mixing part 6, by its axial movement—when such a movement is imparted to it—tends to prevent the undesirable accumulation of mascara on the inside surface 10*aa* of the side wall 7 of the bottle 5.

However, in all cases, the mixing part 6 does not come under pressure, even slightly, and with a scraping function over the entirety of the inside surface 10*aa* of the side wall 7 of the bottle 5.

In the embodiment shown, the radial dimension of the space 28 between the outside surface 22*a* of the mixing part 6 and the inside surface 10*aa* of the side wall 7 of the bottle 5 is less than on the order of 0.08 times the large transverse dimension of the outside surface 22*a* of the mixing part 6 and/or is less than on the order of 0.10 times the large dimension of the inside surface 10*aa* of the side wall 7 of the bottle 5.

Thus, the mixing part 6 maintains an axial or approximately axial positioning of axis AA, while being in a certain way "guided" or "framed" by the side wall 7 of the bottle 5, but without contact, or without substantial contact, and/or persistent contact, and/or peripheral contact with its inside surface 10*aa*. The mixing part 6 can be moved into the receiving cavity 11, in a translational movement along the axis AA, as the case may be with a certain possibility of rotation around the axis AA. In contrast, the mixing part 6 cannot pivot or substantially pivot around a transverse axis in relation to the axis AA and get stuck in the receiving cavity 11. And, likewise, the mixing part 6 cannot collide with the applicator 3 in a way that would limit, prevent, restrain or hinder its axial translational movement. Consequently, the transverse dimensions of the mixing part 6 have a relationship with the transverse dimensions of the side wall 7 of the bottle 5 and of the applicator 3, rod 17, and brush 21.

In the embodiment shown, the area of an end cant edge 24*a*, 24*b* or of its projection on a transverse plane is less than on the order of 0.5 times the area of a transverse section of the receiving cavity 11. More particularly, it is less than on the order of 0.4 times.

The weight of the mixing part 6 is between five and fifty grams and its density is greater than 5, these design arrangements having the effect of imparting to the mixing part 6 the inertia that makes possible its translational movement along the axis AA under the action of a shaking of the container-applicator of mascara in one direction and in the other with at least one component in axial direction.

According to the embodiments, the weight of the mixing part 6 is greater than 15 grams, more particularly is in the vicinity of or greater than on the order of 20 grams, and its density is greater than 6.5, more particularly greater than 7.5, and more particularly still greater than on the order of 8.

Such a mixing part 6 is made of a heavy metal alloy such as zamak, steel, copper alloy or the like. It can be made by cutting a pre-existing tube, or by rolling a sheet, or by molding or any other manner suited to the desired result.

As the case may be, the mixing part 6 has a corrosion-resistant coating, so that its surface state is not altered by the mascara that is found in the receiving cavity 11. In contrast, the mixing part 6 or its coating is inert relative to the mascara, so as not to alter the latter.

As the case may be (see FIGS. 6A, 6B and 6C), holding means 29 are provided combined with the bottle 5 and with the mixing part 6. In the active state, these holding means 29 ensure the holding in position of the mixing part 6 in the receiving cavity 11 so as to prevent or limit its untimely axial movement between the bottom 8 and the neck 9. In the inactive state, these holding means 29 do not hamper the axial movement of the mixing part 6 in the receiving cavity 11.

Such holding means are initially active and are rendered inactive when the receiving cavity 11 is going to be filled or has just been filled with the mascara composition.

In an embodiment, purely by way of example, such holding means 29 in the active state ensure the holding in position of the mixing part 6 against, or in the vicinity of, the bottom 8.

Such holding means 29 can, for example, be made in the form of a forced wedging that can, however, be unwedged by an exterior action of sufficient force of the mixing part 6 in the bottle 5. Such an embodiment can be envisaged with a mixing part 6 that at distal axial end-of-travel rests on the inside surface 10*ab* of the bottom 8, with the part of its outside surface 22*a* located toward the distal end 25*a* that is wedged in the distal annular end 27 of the inside surface 10*aa* of the side wall 7 of the bottle 5, designed so as to be very slightly flared in the proximal direction.

However, such holding means 29 can also be made in the form of a connection that can be broken by a willful action, placed between the mixing part 6 and the bottle 5.

Figure 6A:
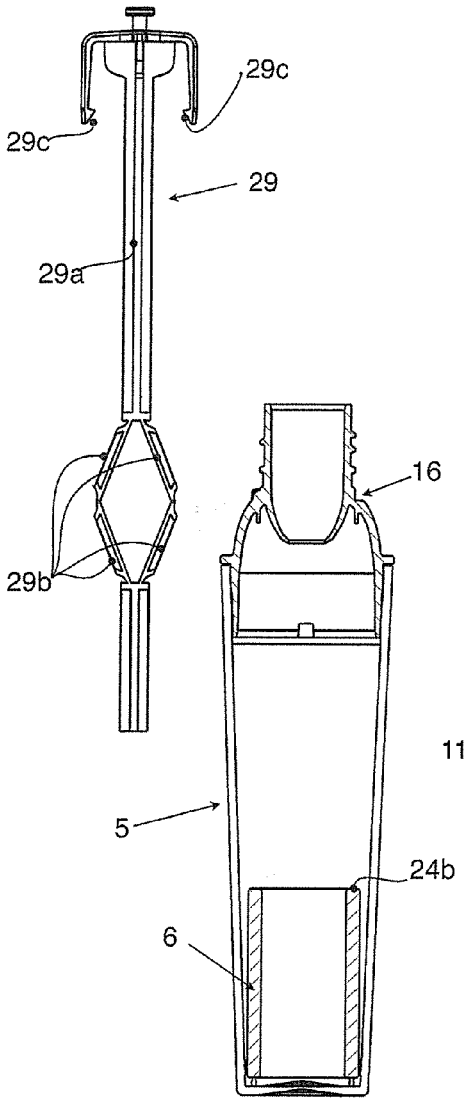
FIGS. 6A, 6B and 6C are three diagrams in axial section illustrating a variant embodiment with holding means.
Figure 6B:
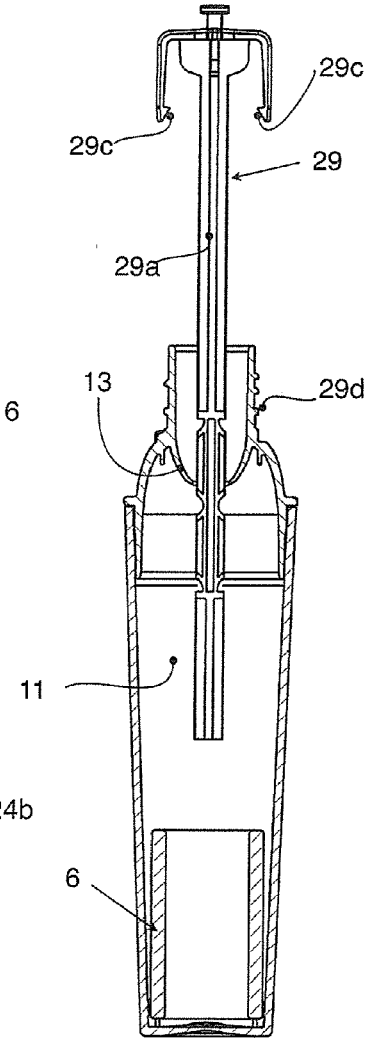
Figure 6C:
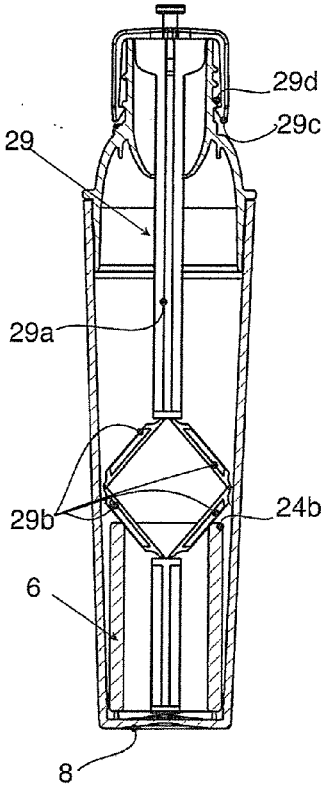

In the embodiment illustrated by FIGS. 6A, 6B and 6C, the holding means 29 are such that the rod 29*a* is deformable and has judiciously placed parts that form a hinge 29*b*. To pass through the squeezing means 13, these parts forming a hinge 29*b* are compressed (FIG. 6B). Then, by pushing on the rod 29*a* toward the bottom 8, the parts forming a hinge 29*b* are forced to open and thus to come up against the proximal cant edge 24*b* of the mixing part 6 that is then blocked. To keep the rod 29*a* in this position, there can be provided, for example, inverse pawl-shaped parts 29*c* and 29*d* that cooperate, next to the rod 29*a* toward its proximal end and to the neck 9 of the bottle 5.

The provision of such holding means 29 makes it possible to avoid, in the situation where a mixing part 6 is placed in the receiving cavity 11 devoid of mascara and remaining open, the handling of this assembly for transport, storage, or the finalization process of the container-applicator of mascara by filling the receiving cavity 11 with the mascara and the insertion of the applicator into the receiving cavity 11 and the joining of the cap 4 on the bottle 5, not causing unexpected movements of the assembly, its turning over, or the untimely movement of its center of gravity.

As the case may be, combined with the bottle 5 and with the mixing part 6, there are provided end-of-travel damping means of movement, in one direction and/or in the other, of the mixing part 6 in the receiving cavity 11.

Such damping means can, for example, be made in the form of elastically deformable parts or pieces, incorporated or attached to the mixing part 6, toward its ends 25*a*, 25*b*, or to the bottle 5, in the receiving cavity 11, toward the bottom 8 or the neck 9.

The provision of such damping means makes it possible to prevent the impact of the end-of-travel of axial movement of the mixing part 6 on the bottom 8 or the neck 9 from damaging the bottle 5, given the force of this impact linked to the inertia of the mixing part 6.

To make a container-mixer such as has been previously described, a bottom part 15 and a neck part 16 and a mixing part 6 are available.

Then, the mixing part 6 is placed in one of the two parts 15 and 16 that form the bottle, and quite especially in the bottom part 15.

Then, the two parts 15 and 16 are rigidly joined to one another, so as to constitute the bottle 5.

Thus, a container-mixer is obtained whose mixing part 6 is placed in the receiving cavity 11 of the bottle 5.

According to a particular embodiment of the process, two parts 15 and 16 are available that have two contact surfaces, one exhibiting a thinning and the other being inclined, and the two surfaces are put in contact under stress by an axial force and fused for their rigid assembling, as is proposed in the document WO 2009/133265.

According to a possible embodiment, the two parts 15 and 16 and a mixing part 6 are available, such that combined with them are holding means as have been previously described, which are initially active or rendered active. And the two parts 15 and 16 are joined with the active holding means until the filling with the mascara.

Such a container-mixer can be transported, stored or finalized by filling the receiving cavity 11 with the mascara and the insertion of the applicator into the receiving cavity 11 and the joining of the cap 4 to the bottle 5, so as to obtain a container-applicator of mascara that will then be able to be transported, stored, put on sale, and finally left to the disposition of the user. This container-applicator is then in the combined and closed configuration, the first and second holding means 14*a* and 14*b* working with one another.

Such a container-applicator of mascara comprises a container-applicator for mascara 1 as has been previously described and a certain amount of mascara forming a mass of mascara that fills the receiving cavity 11.

The mascara, or mascara composition, exhibits the characteristics previously described.

The mass of mascara fills the receiving cavity 11 while being contained by the inside surface 10*a* of the bottle 5 and particularly by the inside surfaces 10*aa* and 10*ab*. The mass of mascara also fills the central passage 23 of the mixing part 6, in communication with the rest of the receiving cavity 11 by the openings 23*a* and 23*b*, or more precisely the part of the central passage 23 outside of the applicator 3, particularly the brush 21. The mixing part 6 is immersed in the mass of mascara that comes into contact with its outside surface 22*a*, with its inside surface 22*b*, and with its cant edges 24*a*, 24*b*, unless the distal cant edge 24*a* is not against the inside surface 10*ab* of the bottom 8. Likewise, the applicator 3, more precisely the distal section 18 and intermediate section 19 of the rod 17 and the brush 21, is immersed in the mass of mascara.

Such a container-applicator of mascara is used as follows by the user.

First of all, a container-applicator of mascara is available in the combined and closed configuration.

Figure 7:
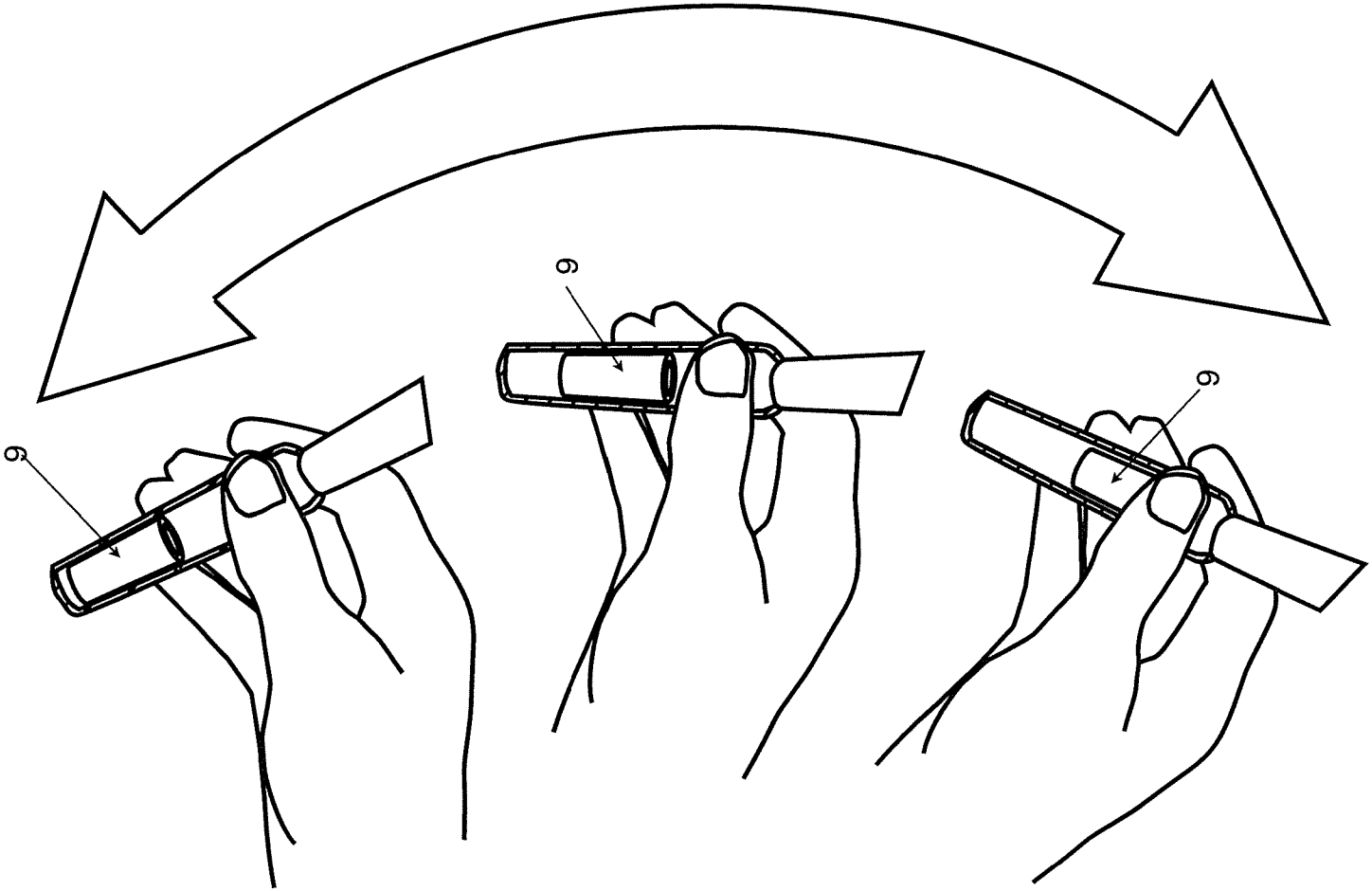
FIG. 7 is a diagram illustrating the implementation process of the container-mixer assembly.

Then, as illustrated diagrammatically by FIG. 7, the container-applicator of mascara is shaken as many times as necessary in one direction and in the other with at least one component in the axial direction of axis AA, so that the mixing part 6 is moved by inertia in the axial direction of axis AA in the receiving cavity 11, in one direction and in the other, while passing through the mass of mascara from the bottom 8 up to the neck 9 and conversely, that is to say over a sufficient travel. In an embodiment, purely by way of example, the length of the travel of axial movement of the mixing part 6 is between on the order of two times to six times the axial length of the mixing part 6.

Thus, on the one hand, the desired degree of mixing of the mass of mascara that is found in the receiving cavity 11 is ensured. On the other hand, the undesirable accumulation of mascara on the inside surface 10*aa* of the side wall 7 of the bottle 5 is prevented.

Then, the first holding elements 14*a* and the second holding elements 14*b* are separated, and the container-applicator assembly of mascara is then brought into the separated and open configuration of the bottle 5 and of the cap 4 and into the separated configuration of the bottle 5 and of the applicator 3.

Finally, the applicator 3 is handled as desired to transfer the mascara from the brush.

Obtaining the desired degree of mixing of the mass of mascara that is found in the receiving cavity 11 results from the fact that the cant edges 24*a* and 24*b* of the mixing part 6 form faces that can "attack" the mass of mascara in the manner of blades of a mixing device and thus can move a certain, recovered, amount of mascara. When the mixing part 6 is moved axially, for example, in the direction going from the distal side toward the proximal side, the proximal cant edge 24*b* pushes and thus moves the mascara that is adjacent to this cant edge. A certain amount of mascara is thus moved and is gradually mixed with the rest of the mass of mascara. The mixing is all the more effective as the mixing part is moved up to where its proximal cant edge 24*b* comes up against the inside surface of the neck 9, the axial movement of the mixing part then being stopped. Then, the mixing part is moved axially in the opposite direction, the distal cant edge 24*a* then being made use of to push and move the mascara.

The effectiveness of the mixing of the mascara rests, on the one hand, on the capability of the mixing part 6 to form faces for moving the mascara in the manner of the blades of a mixing device. For this purpose, it is important that the mixing part 6 have end cant edges 24*a*, 24*b* that can be compared to blades of a mixing device.

The effectiveness of the mixing of the mascara rests, on the other hand, on the capability of the mixing part 6 to be moved while overcoming the resistance opposed by the mass of mascara. For this purpose, it is important to combine the characteristic according to which the area of an end cant edge 24*a*, 24*b* or of its projection on a transverse plane is not too great in comparison to the area of a transverse section of the receiving cavity 11 and the characteristic according to which the mixing part 6 has a sufficient weight to ensure that it is axially moved by inertia by the shaking of the container-mixer of mascara.

The invention claimed is:

1. Container-applicator assembly (1) for a mascara composition comprising, along a longitudinal axis (AA):

a bottle (5), comprising a side wall (7) and a distal bottom (8) whose inside surface (10*a*) delimits a receiving cavity (11) containing a mascara composition, and a proximal neck (9) with an opening (12), provided with squeezing means (13) and with first holding elements (14*a*) of the assembly in a combined and closed configuration, an applicator (3) comprising a rod (17) having a brush carrier (21) distal section (18), an intermediate section (19), and a proximal handling section (20), and a brush (21) carried by the distal section (18) and having bristles that extend transverse to the longitudinal axis, a cap (4) provided with second holding elements (14*b*) of the assembly (1) in the combined and closed configuration, and a mixing means placed in the receiving cavity (11), the mixing means being movable axially between the distal bottom (8) and the proximal neck (9) to mix the mascara composition in the receiving cavity (11), said mixing means being rigid and of a general tubular shape with an outside surface (22*a*) and an inside surface (22*b*) peripherally bounding a traversing central passage (23) through which the rod (17) and bristles of the applicator (3) pass, and two end cant edges (24*a*, 24*b*), wherein the mixing means is a mixing part (6) having a wall of a general tubular shape, whose weight is between five and fifty grams and whose density is greater than five g/cm$^3$, made of a heavy metal alloy, whose area of the end cant edge (24*a*, 24*b*) or of its projection on a transverse plane is less than 0.5 times the area of a transverse section of the receiving cavity (11), and whose outside surface (22*a*) is spaced from the inside surface (10*a*) of the bottle (5) by an annular space whose radial dimension is small compared to the transverse dimensions of the outside surface (22*a*) of the mixing part (6) and of the inside surface (10*aa*) of the side wall (7) of the bottle (5), the annular space being sized to prevent accumulation of the mascara composition on the inside surface of the side wall of the bottle.

2. Container-applicator assembly (1) for a mascara composition according to claim 1, wherein the outside surface (22*a*) and/or the inside surface (22*b*) of the mixing part (6) has a general cylindrical or slightly tapered shape, with a generatrix that is a straight or slightly curved section, and a directrix that is closed or open and whose shape, or whose envelope shape, is circular, pseudo-circular, ellipsoidal, polygonal or pseudo-polygonal.

3. Container-applicator assembly (1) for a mascara composition according to claim 2, wherein the tubular wall of the mixing part (6) is at least approximately solid.

4. Container-applicator assembly (1) for a mascara composition according to claim 2, wherein the traversing central passage (23) of the tubular wall of the mixing part (6) has a sufficient transverse opening to be able to be passed through by the brush (21) of the applicator (3) in a manner such that the brush (21) of the applicator (3), in its large transverse dimension, is separated from the inside surface (22*b*) of the mixing part (6).

5. Container-applicator assembly (1) for a mascara composition according to claim 2, wherein the axial length of the mixing part (6) is at least one of (a) in the vicinity of the axial length of the brush (21) of the applicator (3) and (b) at most equal to 0.5 times the axial length of the receiving cavity (11).

6. Container-applicator assembly (1) for a mascara composition according to claim 2, wherein the weight of the mixing part (6) is greater than 15 grams, or wherein the of the mixing part (6) is greater than 6.5 g/cm$^3$.

7. Container-applicator assembly (1) for a mascara composition according to claim 2, wherein the radial dimension of the space (28) between the outside surface (22*a*) of the mixing part (6) and the inside surface (10*aa*) of the side wall (7) of the bottle (5) is less than 0.08 times the large transverse dimension of the outside surface (22*a*) of the mixing part (6) or is less than 0.10 times the large transverse dimension of the inside surface (10*aa*) of the side wall (7) of the bottle (5).

8. Container-applicator assembly (1) for a mascara composition according to claim 2, wherein the receiving cavity (11) has an axial length at least equal to three times the large transverse dimension of the inside surface (10*a*) of the bottle (5).

9. Container-applicator assembly (1) for a mascara composition according to claim 1, wherein the tubular wall of the mixing part (6) is at least approximately solid.

10. Container-applicator assembly (1) for a mascara composition according to claim 1, wherein the traversing central passage (23) of the tubular wall of the mixing part (6) has a sufficient transverse opening to be able to be passed through by the brush (21) of the applicator (3) in a manner such that the transversely-extended bristles of the applicator (3) are separated from the inside surface (22*b*) of the mixing part (6) by a space where some of the mascara composition is found.

11. Container-applicator assembly (1) for a mascara composition according to claim 1, wherein the axial length of the mixing part (6) is at least one of (a) in the vicinity of the axial length of the brush (21) of the applicator (3) and (b) at most equal to 0.5 times the axial length of the receiving cavity (11).

12. Container-applicator assembly (1) for a mascara composition according to claim 1, wherein the weight of the mixing part (6) is greater than 15 grams, or wherein the density of the mixing part (6) is greater than 6.5 g/cm $^3$.

13. Container-applicator assembly (1) for a mascara composition according to claim 1, wherein the mixing part (6) is made by cutting a pre-existing tube, by rolling a sheet, or by molding, or wherein the mixing part comprises a corrosion-resistant coating.

14. Container-applicator assembly (1) for a mascara composition according to claim 1, wherein the radial dimension of the space (28) between the outside surface (22*a*) of the mixing part (6) and the inside surface (10*aa*) of the side wall (7) of the bottle (5) is at least one of (a) less than 0.08 times the large transverse dimension of the outside surface (22*a*) of the mixing part (6), and (b) less than 0.10 times the large transverse dimension of the inside surface (10*aa*) of the side wall (7) of the bottle (5).

15. Container-applicator assembly (1) for a mascara composition according to claim 1, wherein the receiving cavity (11) has an axial length at least equal to three times the large transverse dimension of the inside surface (10*a*) of the bottle (5).

16. Container-applicator assembly (1) for a mascara composition according to claim 1, further comprising, combined with the bottle (5) and with the mixing part (6), damping means of end-of-travel of axial displacement in at least one direction of the mixing part (6) in the receiving cavity (11).

17. Container-applicator assembly (1) for a mascara composition according to claim 1, wherein:

the bottle (5) and the applicator (3) are either in a separated configuration where the brush (21) is located outside of the receiving cavity (11) or in a combined configuration where the brush (21) is located in the receiving cavity (11) or in a distal position where it is against or in the vicinity of the distal bottom (8) or in a proximal position where it is against or in the vicinity of the neck (9) or of the squeezing means (13) or in an intermediate position, or the bottle (5) and the cap (4) are either in a separated and open configuration where the cap (4) is structurally separated from the bottle (5) and where the opening (12) of the bottle (5) is open or in a combined and closed configuration where the first holding elements (14*a*) and the second holding elements (14*b*) work with one another, where the cap (4) is combined structurally with the bottle (5) and where the opening (12) of the bottle (5) is closed.

18. Container-applicator assembly of mascara that comprises a container-applicator assembly (1) for a mascara composition according to claim 1, further comprising a mascara composition forming a mass of mascara filling the receiving cavity (11), said mascara composition being nonhomogeneous or unstable and viscous in nature or thixotropic, such that by a shaking of the container-applicator assembly (1) of mascara in the combined and closed configuration, in one direction and in the other, the mixing part (6) is moved by inertia in the axial direction in the receiving cavity (11) in one direction and in the other while passing through the mass of mascara, which ensures the desired degree of mixing of the mascara composition.

19. Container-applicator assembly (1) for a mascara composition comprising, along a longitudinal axis (AA):

a bottle (5), comprising a side wall (7) and a distal bottom (8) whose inside surface (10*a*) delimits a receiving cavity (11) able to receive a mascara composition, and a proximal neck (9) with an opening (12), provided with squeezing means (13) and with first holding elements (14*a*) of the assembly in a combined and closed configuration, an applicator (3) comprising a rod (17) having a brush carrier (21) distal section (18), an intermediate section (19), and a proximal handling section (20), and a brush (21) carried by the distal section (18), a cap (4) provided with second holding elements (14*b*) of the assembly (1) in the combined and closed configuration, and a mixing means placed in the receiving cavity (11), the mixing means being movable axially between the distal bottom (8) and the proximal neck (9) while being able to mix a mascara composition in the receiving cavity (11), said mixing means being rigid and of a general tubular shape with an outside surface (22*a*) and an inside surface (22*b*) peripherally bounding a traversing central passage (23) that can be passed through by the rod (17) of the applicator (3), and two end cant edges (24*a*, 24*b*), wherein the mixing means is a mixing part (6) having a wall of a general tubular shape, whose weight is between five and fifty grams and whose density is greater than five g/cm$^3$, made of a heavy metal alloy, whose area of the end cant edge (24*a*, 24*b*) or of its projection on a transverse plane is less than 0.5 times the area of a transverse section of the receiving cavity (11), and whose outside surface (22*a*) is spaced from the inside surface (10*a*) of the bottle (5) by a space whose radial dimension is small, relatively, in comparison with the transverse dimensions of the outside surface (22*a*) of the mixing part (6) and of the inside surface (10*aa*) of the side wall (7) of the bottle (5), the container-applicator assembly (1) further comprising, combined with the bottle (5) and with the mixing part (6), holding means (29) that in the active state ensure the holding in position of the mixing part (6) in the receiving cavity (11) so as to prevent or limit its axial movement between the distal bottom (8) and the proximal neck (9) and in the inactive state do not hamper the movement of the mixing part (6) in the receiving cavity (11), said holding means (29) being initially in the active state and being returned to the inactive state when the receiving cavity (11) is going to be filled or has just been filled with the mascara composition.

20. Container-mixer assembly intended to be part of a container-applicator assembly (1) for a mascara composition, comprising, along a longitudinal axis (AA):

a bottle (5), comprising a side wall (7) and a distal bottom (8) whose inside surface (10*a*) delimits a receiving cavity (11) containing a mascara composition, and a proximal neck (9) with an opening (12), provided with squeezing means (13) and with first holding elements (14*a*) of the assembly (1) in a combined and closed configuration, and a mixing means placed in the receiving cavity (11), the mixing means being movable axially between the distal bottom (8) and the proximal neck (9) while being able to mix the mascara composition in the receiving cavity (11), said mixing means being rigid and of a general tubular shape with an outside surface (22*a*) and an inside surface (22*b*) peripherally bounding a traversing central passage (23) that can be passed through by a rod (17) of an applicator (3), and two end cant edges (24*a*, 24*b*), wherein the mixing means is a mixing part (6) whose weight is between five and fifty grams and whose density is greater than five g/cm $^3$, made of a heavy metal alloy, whose area of the end cant edge (24*a*, 24*b*) or of its projection on a transverse plane is less than 0.5 times the area of a transverse section of the receiving cavity (11), and whose outside surface (22*a*) is spaced from the inside surface (10*a*) of the bottle (5) by an annular space whose radial dimension is small compared to the transverse dimensions of the outside surface (22*a*) of the mixing part (6) and of the inside surface (10*aa*) of the side wall (7) of the bottle (5), the annular space being sized to prevent accumulation of the mascara composition on the inside surface of the side wall of the bottle.

* * * * *